US011624568B2

(12) United States Patent
Ballard et al.

(10) Patent No.: US 11,624,568 B2
(45) Date of Patent: Apr. 11, 2023

(54) BOLT ASSEMBLY

(71) Applicant: Springfield, Inc., Geneseo, IL (US)

(72) Inventors: Nick Ballard, Galva, IL (US); Charles David Williams, Geneseo, IL (US); Christopher Martin Baumbach, LeClaire, IA (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 17/456,036

(22) Filed: Nov. 22, 2021

(65) Prior Publication Data

US 2022/0163275 A1 May 26, 2022

Related U.S. Application Data

(60) Provisional application No. 63/117,649, filed on Nov. 24, 2020.

(51) Int. Cl.
*F41A 3/22* (2006.01)
*F41A 3/20* (2006.01)

(52) U.S. Cl.
CPC . *F41A 3/22* (2013.01); *F41A 3/20* (2013.01)

(58) Field of Classification Search
CPC ..... F41A 3/12; F41A 3/14; F41A 3/16; F41A 3/18; F41A 3/20; F41A 3/22; F41A 3/24; F41A 3/32; F41A 3/34; F41A 3/36; F41A 3/40; F41A 3/42; F41A 3/38; F41A 3/44;
(Continued)

(56) References Cited

U.S. PATENT DOCUMENTS 3,341,963 A * 9/1967 Seiderman ..... F41A 3/20 42/16
3,404,480 A 10/1968 Koucky et al.
3,432,955 A 3/1969 Vartanian et al.
(Continued)

FOREIGN PATENT DOCUMENTS

CH 23833 4/1901
CH 227818 7/1943
(Continued)

OTHER PUBLICATIONS

English Translation of CH227816 entitled: From Open Position Shutter Shooting Unlatched Automatic Weapon, Especially Machine Gun. Retrieved Jun. 23, 2022.
(Continued)

*Primary Examiner* — John Cooper
(74) *Attorney, Agent, or Firm* — Woodard, Emhardt, Henry, Reeves & Wagner, LLP

(57) ABSTRACT

A method of assembling a bolt handle to a bolt assembly of a firearm includes inserting the bolt handle through a handle opening defined by a bolt body. A distal end of the bolt handle is inserted through the handle opening until the distal end extends past an outer perimeter of the bolt body. At least a portion of a bolt shroud is inserted through a first portion of an aperture defined by the bolt handle. A force is applied to the bolt shroud while the bolt handle is retracted within the handle opening of the bolt body so that the bolt shroud is positioned within a second portion of the aperture. The bolt shroud is held in connection with the bolt handle when the bolt shroud is positioned within the second portion of the aperture to secure the bolt handle to the bolt body.

19 Claims, 14 Drawing Sheets

(58) Field of Classification Search
CPC ..... F41A 3/46; F41A 3/48; F41A 3/50; F41A 3/52
USPC ..... 42/14–16, 69.02, 69.03
See application file for complete search history.

(56) References Cited

U.S. PATENT DOCUMENTS

| | | | | |
|---|---|---|---|---|
| 3,631,620 | A | 1/1972 | Ohira | |
| 3,816,950 | A | 6/1974 | Vesamaa | |
| 5,606,825 | A * | 3/1997 | Olsen | F41A 3/72 89/1.3 |
| 6,000,161 | A | 12/1999 | Aalto | |
| 6,418,655 | B1 * | 7/2002 | Kay | F41F 1/08 89/185 |
| D610,218 | S | 2/2010 | Barrett | |
| 7,950,177 | B2 * | 5/2011 | Laney | F41A 15/14 89/185 |
| D640,766 | S | 6/2011 | Joplin | |
| D670,783 | S | 11/2012 | Barrett | |
| 8,925,230 | B2 * | 1/2015 | Warburton | F41A 3/14 89/1.4 |
| 9,151,553 | B2 | 10/2015 | Constant et al. | |
| D774,619 | S | 12/2016 | Mather | |
| D785,122 | S | 4/2017 | Mather et al. | |
| 9,885,528 | B2 | 2/2018 | Mather | |
| 10,006,726 | B1 | 6/2018 | Oglesby | |
| D827,753 | S | 9/2018 | Lessard et al. | |
| 10,077,957 | B1 | 9/2018 | Aguf | |
| D854,643 | S | 7/2019 | Schafer et al. | |
| 10,458,731 | B2 * | 10/2019 | Mather | F41A 3/22 |
| 10,458,733 | B2 | 10/2019 | Karagias | |
| D868,196 | S | 11/2019 | Schafer | |
| 10,514,219 | B2 | 12/2019 | Schafer | |
| D891,561 | S | 7/2020 | Parket et al. | |
| 2004/0168362 | A1 | 9/2004 | Aalto et al. | |
| 2010/0257768 | A1 | 10/2010 | Barrett | |
| 2010/0307042 | A1 | 12/2010 | Jarboe et al. | |
| 2011/0232148 | A1 | 9/2011 | Cain et al. | |
| 2012/0137557 | A1 | 6/2012 | Klotz | |
| 2012/0180360 | A1 | 7/2012 | Jones | |
| 2014/0013641 | A1 * | 1/2014 | Warburton | F41A 3/14 42/16 |
| 2014/0068986 | A1 | 3/2014 | Pietrzyk et al. | |
| 2014/0196343 | A1 | 7/2014 | Wilson et al. | |
| 2015/0233656 | A1 * | 8/2015 | Karagias | F41A 3/14 42/16 |
| 2015/0330727 | A1 | 11/2015 | Kolev et al. | |
| 2015/0338186 | A1 | 11/2015 | Hopkins | |
| 2016/0047611 | A1 | 2/2016 | Battaglia et al. | |
| 2016/0202016 | A1 | 7/2016 | Mather et al. | |
| 2016/0252314 | A1 * | 9/2016 | Mather | F41A 3/30 42/16 |
| 2017/0010064 | A1 * | 1/2017 | Karagias | F41A 3/14 |
| 2018/0195818 | A1 * | 7/2018 | Schafer | F41A 15/12 |
| 2018/0195823 | A1 * | 7/2018 | Schafer | F41A 19/30 |
| 2018/0202756 | A1 | 7/2018 | Shinkle et al. | |
| 2018/0335266 | A1 | 11/2018 | Cochran et al. | |
| 2019/0078849 | A1 * | 3/2019 | Schafer | F41A 3/22 |
| 2019/0128639 | A1 | 5/2019 | Parker et al. | |
| 2020/0263942 | A1 * | 8/2020 | Karagias | F41A 3/72 |
| 2021/0381784 | A1 * | 12/2021 | Alomaira | F41A 3/22 |

FOREIGN PATENT DOCUMENTS

| | | | | |
|---|---|---|---|---|
| DE | 1064389 | | 8/1959 | |
| DE | 941743 | | 5/1996 | |
| DE | 202010015858 | | 11/2010 | |
| DE | 102010018139 | | 10/2011 | |
| DE | 202010006040 | | 2/2012 | |
| DE | 202010015858 | U1 * | 4/2012 | F41A 3/18 |
| GB | 137617 | | 1/1920 | |
| GB | 778083 | | 7/1957 | |

OTHER PUBLICATIONS

English Translation of CH23833 entitled Device for Preventing the Closure at Selbsttaetigen Opening Repeating Rifles With Straight Pull. Retrieved Jun. 23, 2022.
English translation of DE102010018139 entitled: Locking Piece for Handgun, Comprises Locking Body and Operating Handle Which is Provided With Compressed Inner Part That is . . . .
English translation of DE1064389 entitled: Assurance for Automatic Weapons. Retrieved Jun. 23, 2022.
English Translation of DE 202010006040 entitled: Closure of a Handgun. Retrieved Jun. 23, 2022.
English translation of DE 202010015858 entitled: Chamber for a Repetitive Rifle. Retrieved Jun. 23, 2022.
English Translation of DE9419743 entitled: Closure for a Repeating Firearm. Retrieved Jun. 23, 2022.
SIG Cross Bolt Action Video, YouTube, [retrieved on Jan. 14, 2021], Retrieved from <https://www.youtube.com/watch?v=8r36hBmzf3A&t=356s.
SIG Cross Operators Manual, SIG SAUER, Retrieved Jan. 4, 2021.

* cited by examiner

BOLT ASSEMBLY

CROSS REFERENCE TO RELATED APPLICATIONS

The present patent document claims the benefit of the filing date of Provisional U.S. Patent Application No. 63/117,649, filed on Nov. 24, 2020, which is hereby incorporated by reference in its entirety.

BACKGROUND

The present invention pertains generally to firearms and, in particular aspects, to bolt handle arrangements for a firearm.

A bolt-action rifle is a type of firearm that requires the manual operation of a bolt through the use of a bolt handle to load and to extract cartridges from the chamber of the weapon. Bolt-action rifles are dependable, easy to use, and are generally considered to be more accurate than an automatic or semi-automatic weapon. These qualities make a bolt-action rifle a popular firearm despite the decreased rate of fire due to the manual operation.

Many owners desire to customize their firearm to make the firearm more comfortable and easy to use, as well as to modify the size and the shape of the firearm. In some instances, this customization may include the bolt handle. For some weapons, the bolt handle is integrally attached to the bolt, making customization difficult by requiring sawing or special tools to remove the bolt handle or requiring modification of the entire bolt assembly. Other firearms allow removal of the bolt handle but require a complicated process for disassembly and reassembly. Still others are simply too challenging for users, particularly users with poor grip strength, to disassemble and/or reassemble.

Thus, there is a need for improvement in this field.

SUMMARY

The present disclosure pertains generally to firearms and, more specifically, to the attachment of a bolt handle to a bolt of a firearm (e.g., a bolt-action firearm), such as a shotgun, rifle, or pistol. In certain aspects, the present disclosure provides bolt handle assemblies and methods of assembling and/or disassembling bolt handle assemblies by translation of the bolt handle and/or a bolt shroud relative to the bolt.

Bolt assemblies of the present disclosure may comprise a bolt body including opposing sidewalls and a bolt cavity defined between the opposing sidewalls with a firing pin axis extending through the bolt cavity, wherein a handle opening is defined by the bolt body; a bolt handle including a knob portion and a body portion, wherein the body portion is insertable through the handle opening of the bolt body, and wherein an aperture having first and second portions is defined by the body portion.

Methods of assembling a bolt assembly may comprise: inserting a bolt handle into a handle opening defined by a bolt body so as to position a portion of the bolt handle within the handle opening, inserting a portion of a bolt shroud into a first portion of an aperture defined by the bolt handle; and retracting the bolt handle relative to the handle opening to move the portion of the bolt shroud into a second portion of the aperture defined by the bolt handle. Inserting the bolt handle may comprise passing a distal end of a bolt handle through the handle opening defined by a bolt body so as to position the distal end of the bolt handle outside an outer perimeter of the bolt body. Additionally or alternatively, methods may comprise moving a bolt handle in a first direction relative to the bolt, moving the bolt shroud relative to the bolt handle; and them moving the bolt handle in a second direction opposite the first direction. For example, methods of disassembling of bolt assembly may comprise moving in a first direction a bolt handle inserted through a handle opening defined by a bolt body so that a portion of a bolt shroud moves into a first portion of an aperture defined by the bolt handle from a second portion of the aperture; removing the portion of the bolt shroud from the first portion of the aperture defined by the bolt handle; and moving in a second direction opposite the first direction the bolt handle to remove the bolt handle from the handle opening of the bolt body.

The second portion of the aperture may have a cross-sectional dimension that is smaller than a corresponding cross-sectional dimension of the first portion of the aperture. For example, as measured in a direction orthogonal to the firing pin axis and/or bolt axis and orthogonal to the direction of insertion of the bolt handle through the handle opening, the dimension of the first portion may be greater than the second portion. Additionally and/or alternatively, the first portion of the aperture may be positioned closer to the knob portion of the bolt handle than the second portion of the aperture.

The bolt body includes a firing-pin axis. Preferably, when the first portion of the aperture is aligned with the firing-pin axis the distal end of the bolt handle is outside an outer perimeter of the bolt body. Accordingly, retracting the bolt handle may bring the distal end of the bolt handle flush with or within the outer perimeter of the bolt body. A hard stop may stop movement of the bolt handle into the handle opening when the first portion is aligned with the firing-pin axis. Preferably, a firing pin is coupled to the bolt shroud and the firing pin is inserted through the first portion of the aperture defined by the bolt handle before the portion of the bolt shroud is inserted through the first portion of the aperture.

Preferably, the bolt shroud in the second portion resists movement of the bolt handle to in the handle opening (e.g., movement to align the first portion of the aperture with the firing-pin axis). For example, the body portion may include a feature arranged to resist movement of the bolt shroud away from the bolt body when the bolt assembly is assembled. For example, a seat may be defined along a portion of a perimeter of the second portion. The seat may receive a portion of the bolt shroud when the bolt handle is secured to the bolt body by the bolt shroud and/or the bolt shroud is retained to the bolt body by the bolt handle. The seat may be a recess in an outer surface of the bolt body.

Body portion may additionally/alternatively include a feature arranged to resist movement of the bolt handle out of the bolt body when the bolt assembly is assembled. For example, body portion may include a protrusion (e.g., detent) arranged to interfere with a portion of the bolt shroud and resist movement of the bolt shroud from the second portion to the first portion. For example, the protrusion may be positioned at and end of the seat facing the intermediate portion. The protrusion may project towards the handle aperture and/or above the seat. The protrusion may have a triangular shape and/or may have curved sides. As shown in the illustrated embodiment, a side of the protrusion may face the second portion of the handle aperture and/or a side of the protrusion may face the first portion of the handle aperture. The protrusion may have a height that is equal to and/or less than the depth of a recess defining the seat.

The bolt shroud includes a bolt shroud body. A bolt shroud tang may extend from the bolt shroud body. The bolt shroud tang may have a segment with a first cross-sectional dimension and a second cross-sectional dimension. For example, bolt shroud tang may include a tang body and notch that has a smaller cross-sectional dimension (e.g., diameter) than the tang. The first cross-sectional dimension (e.g., the cross-sectional dimension of the tang body such as its diameter) may be the same as or smaller than the cross-sectional dimension (e.g., diameter) of the first portion of the handle aperture of the bolt handle so that the first cross-sectional dimension of the bolt shroud tang can pass at least partially through the first portion of the handle aperture. The first cross-sectional dimension of the bolt shroud tang is preferably larger than the cross-sectional dimension (e.g., diameter) of the second portion of the handle aperture of the bolt handle. Advantageously, this can resist movement of the first cross-sectional dimension of the tang body through the second portion of the handle aperture when the bolt shroud is positioned in the second portion of the handle aperture.

A bolt shroud cavity may be defined by the bolt shroud tang and the bolt shroud body. A shroud cap may be positioned within a slot defined by the bolt shroud body that is in communication with the bolt shroud cavity. The shroud cap can have a shroud cap aperture configured to receive a rearward end of a firing pin that is part of the bolt assembly. An attachment opening defined by the shroud cap may receive an attachment mechanism, such as a screw, for attaching the firing pin to the shroud cap.

The methods may comprise alternating movement of the bolt shroud and bolt handle. For example, moving the bolt shroud may occur between movement of the bolt handle in the first direction and the second direction. The bolt shroud may move in a third direction prior to moving the bolt handle in the first direction and/or second direction. The bolt shroud may move in a fourth direction after moving the bolt handle in the first direction and/or second direction. The fourth direction may be opposite to the third direction.

Movement in the first and/or second directions may be translational movement. Movement in the third and/or fourth directions may be translational movement.

A method of assembling the bolt handle will now be described. In a first stage, the bolt handle, and more specifically, the body portion of bolt handle, is inserted through the handle opening of the bolt body. To insert the bolt handle, a force that is transverse to the direction of the bolt axis is applied to the bolt handle to insert the body portion of the bolt handle through the handle opening. The body portion may be inserted through the bolt handle opening so that the distal end of the bolt handle extends past the outer perimeter of the bolt body.

In some embodiments, a hard stop may be present that limits the bolt handle from being inserted through the handle opening past a certain point. As an example, this hard stop may be designed to stop further insertion of the bolt handle when the bolt handle is positioned so that the first portion of the handle aperture of the bolt handle is aligned with the barrel axis of the firearm. The hard stop may be formed by the curvature between the intermediate portion and the body portion of the bolt handle. In other embodiments, different forms of hard stops may be used to limit insertion of the of the bolt handle into the handle opening once the first portion of the aperture is aligned with the barrel axis, such as a tab that extends from the bolt handle or any other suitable method and/or having different outer dimensions and/or shapes of the bolt handle that interfere with the bolt body.

In a second stage, the bolt shroud tang is passed at least partially through the first portion of the handle aperture of the bolt handle. The firing pin may be attached to the bolt shroud, so that the firing pin passes through the first portion of the handle aperture along the barrel axis of the firearm, and then the bolt shroud tang is inserted at least partially through the first portion of the handle aperture. In some embodiments, the bolt shroud tang is inserted through the first portion of the handle aperture until the seat of the bolt handle is positioned rearward of the tang body (e.g., aligned with the notch of the bolt shroud tang).

When the bolt shroud tang is passed at least partially through the first portion of the handle aperture, the firing pin spring is compressed and applies force in a rearward direction to the bolt shroud. Accordingly, in a third stage which may occur during the second stage, force is applied to the bolt shroud along the direction of the bolt axis towards the forward end of the bolt body. The force applied to the bolt shroud causes the bolt shroud tang to move forward against the bias of the firing pin spring, so that the tang body is forward of the seat and the protrusion.

In a fourth stage, the bolt handle is retracted within the handle opening, perhaps while the force from the third stage is still applied to the bolt shroud. Preferably, the bolt handle is retracted a sufficient distance so that the second portion of the handle aperture is aligned with the barrel axis of the firearm. In some instances, second portion of the handle aperture is aligned with the barrel axis after the bolt handle is retracted to a position in which the distal end is flush with or within the outer perimeter of the bolt handle. Preferably, the bolt shroud tang remains at least partially passed through the bolt handle as the bolt handle is retracted within the handle opening. Therefore, bolt shroud tang moves from first portion of the handle aperture into second portion of the handle aperture as the bolt handle is retracted within the handle opening.

In a fifth stage, the force applied on the bolt shroud in the second stage, third stage, and/or fourth stage may be released. The firing pin spring biases the bolt shroud so that the bolt shroud tang contacts the seat around the second portion of the handle aperture. When the bolt shroud tang contacts the seat, the protrusion is adjacent to the tang body and resists lateral movement of bolt handle that may move bolt shroud tang into the first portion of the handle aperture.

A method of disassembling the bolt handle will now be described. In a first stage, force is applied to the bolt shroud in the direction of the barrel axis. Similar to the method of assembly described above, applying force on the bolt shroud causes the tang body of the bolt shroud tang to move forward of the seat and protrusion. Therefore, after sufficient force is applied to the bolt shroud, the protrusion no longer resists movement of the bolt handle with respect to the bolt shroud.

In a second stage, force is applied to the bolt handle in a direction that is transverse to the barrel axis. The force applied to the bolt handle causes bolt handle to move (e.g., translate and/or slide) within the handle opening so that the bolt shroud tang moves from the second portion of the handle aperture into the first portion of the handle aperture of the body portion of the bolt handle. During such movement, the distal end of the body portion of bolt handle may extend past the outer perimeter of the bolt body. The bolt shroud tang and the firing pin may remain stationary as the bolt handle is moved within the handle opening.

In a third stage, the bolt shroud tang is moved rearward along the barrel axis so that the bolt shroud tang is removed from the first portion of the handle aperture of the bolt handle. When the firing pin is attached to the bolt shroud, the firing pin may also be removed from the bolt body through the first portion of the handle aperture of the bolt handle.

In a fourth stage, the bolt handle may be removed from the bolt body by withdrawing the bolt handle from the handle opening of the bolt body. When the bolt assembly is assembled, the bolt shroud tang and/or the firing pin prevent the bolt handle from being removed from the handle opening. However, with the bolt shroud tang and the firing pin removed, there is clearance for the bolt handle to slide within the handle opening and to be removed for disassembly. Disassembly allows the bolt assembly and/or components thereof to be cleaned, repaired, changed, and/or stored separately from the firearm.

Advantageously, arrangements wherein the distal end of the body portion of bolt handle extends beyond the outer perimeter of the bolt body during disassembly can aid in preventing the inadvertent removal of the bolt handle from the bolt body while the bolt assembly is positioned within a firearm. When positioned within the firearm, the bolt resides within a receiver, and the receiver can block the distal end of the bolt handle from movement beyond the outer surface of the bolt body sufficient to move the bolt shroud into the first portion of the aperture of the bolt handle. Accordingly, removable of the bolt shroud, firing pin, and bolt handle can be prohibited when the bolt assembly is in the receiver of the firearm.

Advantageously, methods disclosed herein may not require rotation of either the bolt handle or the bolt shroud to allow the bolt handle to be attached to or removed from the bolt body. Applying rotational force can be difficult for some individuals. Additionally, it can be difficult to apply rotational force to small and/or smooth components. In contrast, translational force can be easier for an individual to apply as it does not necessarily rely on grip strength nor clamping a component. The force applied to the bolt handle to insert the bolt handle through the handle opening in the bolt body may be applied in a transverse direction to the bolt axis and may be translational rather than rotational. Similarly, the force applied to the bolt shroud may be applied in a direction parallel to the bolt axis and also may not require any rotational force. It is contemplated, however, that movement of the bolt handle and/or bolt shroud may include rotational movement if desired.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
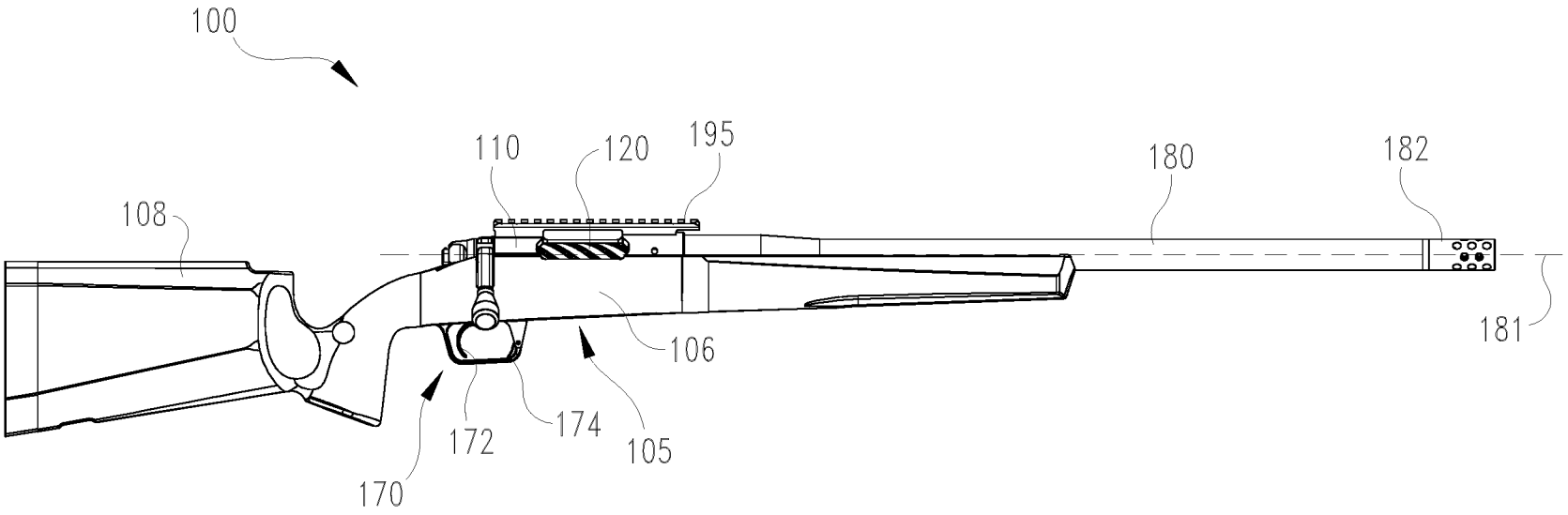
FIG. 1 is a side view of a firearm with a bolt in a locked configuration.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Directional terms, such as forward, rearward, top, bottom, etc., may be used in this description with reference to the specific embodiment shown and used for purposes of clarity. It should be recognized that these terms are not meant to be limiting.

FIG. 1 illustrates a firearm 100. In the embodiment shown, the firearm 100 is a rifle and more particularly a bolt-action rifle. Firearm 100 includes a stock assembly 105 that includes a body 106 and a buttstock 108 that extends rearward therefrom. The buttstock 108 may be integrally formed with the body or may be formed separately and attached thereto. A receiver 110 is positioned within the body 106 of the stock assembly 105. A bolt assembly 120 is housed within the receiver 110, and a bolt handle 130 of the bolt assembly 120 extends outside of the receiver 110 to allow manual operation (e.g., reciprocation) of the bolt assembly 120.

Firearm 100 includes a trigger assembly 170 having a trigger 172 that projects from the underside of the body 106. A trigger guard 174 surrounds the trigger 172 to resist inadvertent actuation of the trigger 172. Trigger assembly 170 may be included as a portion of receiver 110.

A barrel 180 is affixed to and extends forward from the receiver 110. The barrel 180 includes a rifled bore 184 and defines a barrel axis 181 extending longitudinally therethrough. The barrel 180 may be supported by the body 106 of the stock assembly 105. In some instances the barrel 180 is "free floating" and does not contact a forward portion of the stock assembly 105. In some embodiments, a muzzle brake 182 may be positioned at the forward end of the barrel 180. The muzzle brake 182 may be used to redirect propellant gases created during firing of the firearm 100 to counteract recoil and/or muzzle rise.

An accessory rail 195 may be attached to the receiver 110 above the bolt assembly 120 to provide a location to attach any desired accessories, such as a scope, to the firearm 100. In the embodiment shown, the accessory rail 195 takes the form of a Picatinny rail; however, any variety of rail interface system suitable for attaching accessories to a firearm may be used.

Figure 2A:
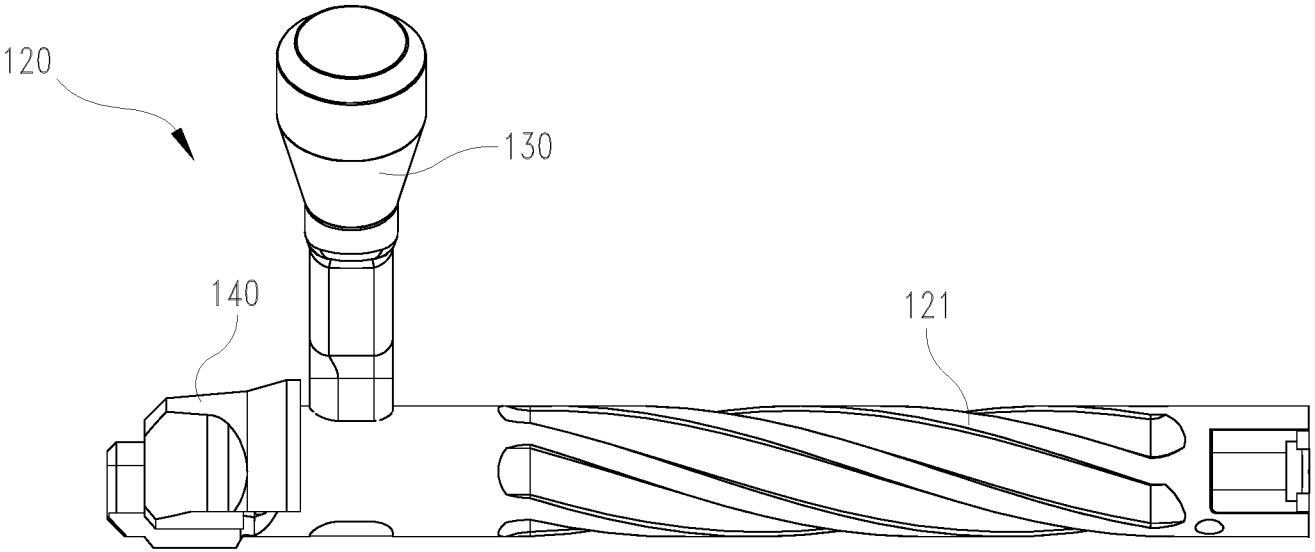
FIG. 2*a* is a side view of a bolt assembly of the firearm of FIG. 1 with the bolt in the unlocked configuration.
Figure 2B:
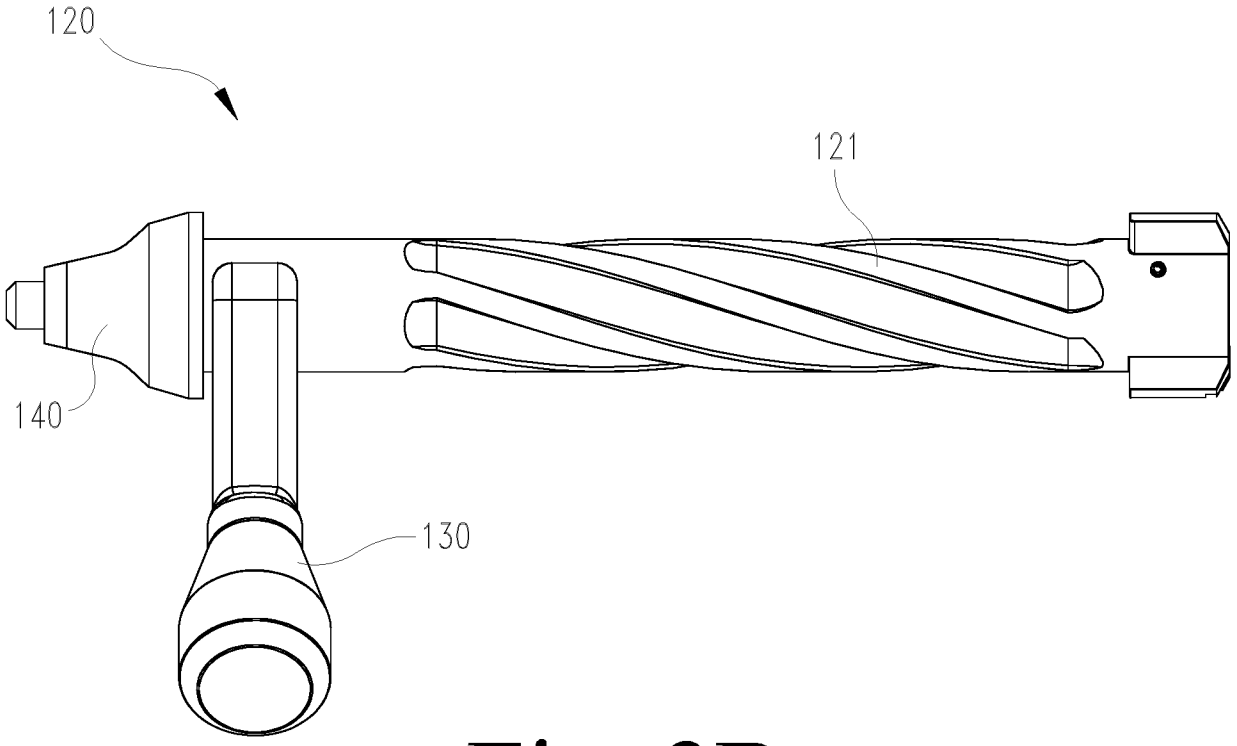
FIG. 2*b* is a top view of a bolt assembly of the firearm of FIG. 2*a*.

The bolt assembly 120 of firearm 100 is illustrated in FIGS. 2*a* and 2*b*. The bolt assembly 120 includes a bolt body 121. The bolt body 121 has a forward end that is positioned near the barrel 180 and a rearward end nearer to the buttstock 108 when the bolt assembly 120 is assembled in the firearm. A bolt handle 130 is coupled to the bolt body 121 near the rearward end of the bolt body 121. A bolt shroud 140 is coupled to the bolt body 121 and positioned rearward of the bolt handle 130 at the rearward end of the bolt body 121.

Figure 3:
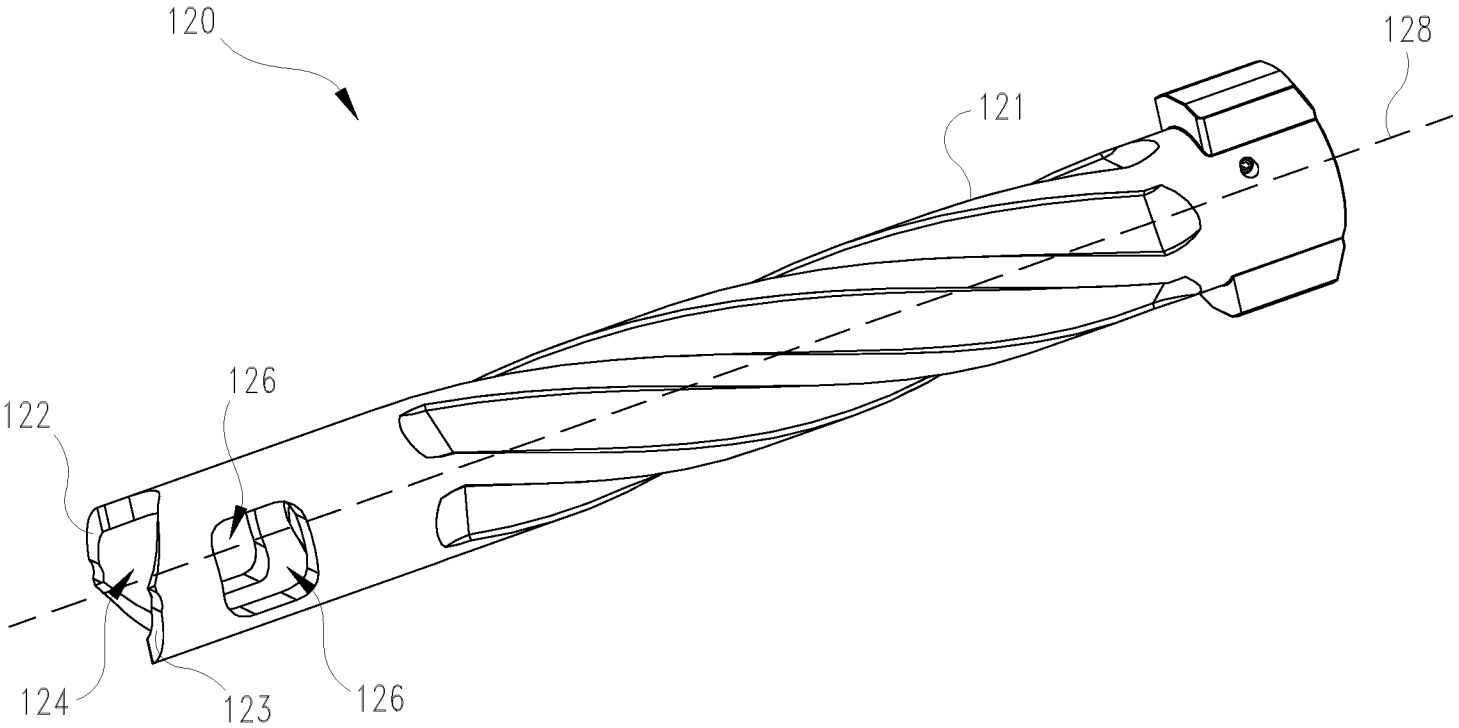
FIG. 3 is a perspective view of a bolt body of the bolt assembly of FIG. 2*a*.

A perspective view of the bolt body 121 is shown in FIG. 3. The bolt body 121 includes opposing sidewalls 122, 123. Outer surfaces of the opposing sidewalls 122, 123 define an outer perimeter of the bolt body 121. A bolt cavity 124 is defined between inner surfaces of the opposing sidewalls 122, 123. A handle opening 126 is defined by the sidewalls 122, 123 of bolt body 121. The handle opening 126 is arranged to receive a portion of the bolt handle 130 extending transversely through the bolt body 121. A bolt axis 128 runs longitudinally through the center of the bolt body 121. In most embodiments, the bolt axis 128 is coaxial with a firing pin axis and/or the barrel axis 181 when the bolt assembly 120 is positioned in the firearm 100. Although the bolt body 121 shown in FIG. 3 has a cylindrical shape, in other embodiments, the bolt body may be any other suitable shape.

Figure 4A:
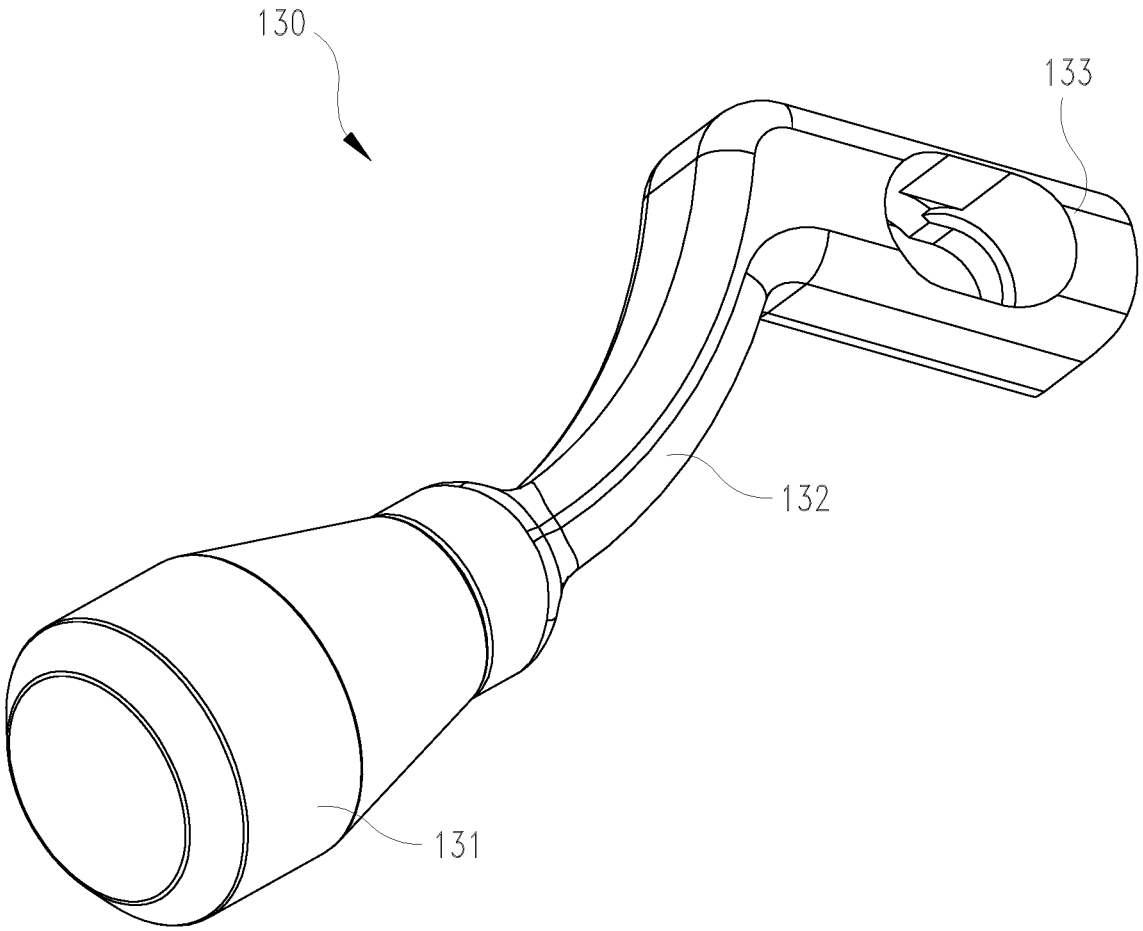
FIG. 4*a* is a perspective view of a bolt handle of the bolt assembly of FIG. 2*a*.
Figure 4B:
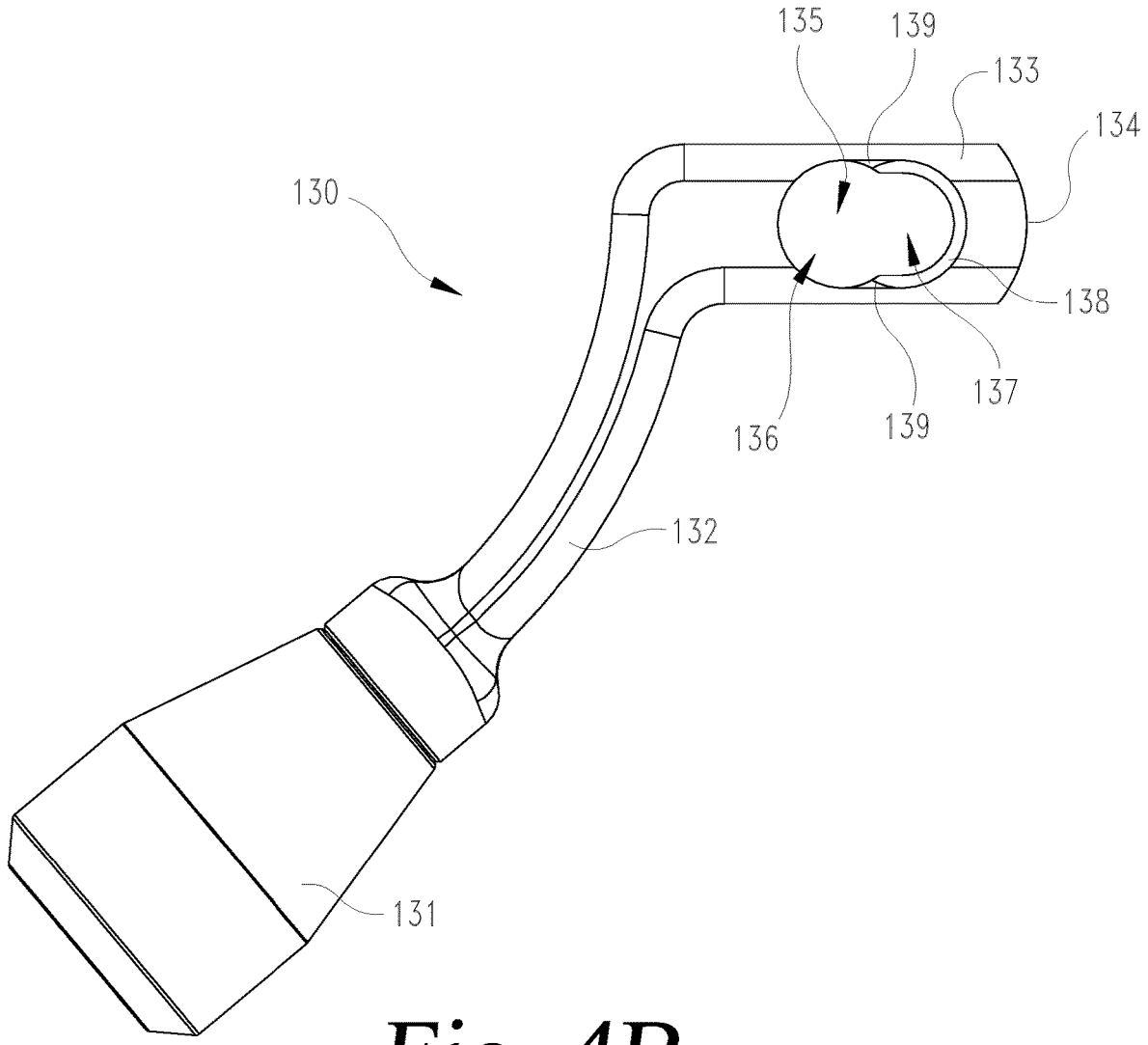
FIG. 4*b* is a front view of a bolt handle of the bolt assembly of FIG. 2*a*.

The bolt handle 130 is shown in FIGS. 4*a* and 4*b*. Bolt handle 130 includes a knob portion 131, an intermediate portion 132, and a body portion 133. The intermediate portion 132 is positioned intermediate the knob portion 131 and the body portion 133. The body portion 133 includes a distal end 134 opposite the intermediate portion 132. The body portion 133 is sized and configured for receipt in the handle openings 126 defined by the bolt body 121. The body portion 133 defines a handle aperture 135.

Handle aperture 135 includes a first portion 136 and a second portion 137. First portion 136 has a larger cross-sectional dimension (e.g., diameter) than second portion 137. For example, as measured in a direction orthogonal to the firing pin axis and/or bolt axis 128 and orthogonal to the direction of insertion of the bolt handle 130 through the handle opening 126, the dimension of the first portion 136 may be greater than the second portion 137. As shown in FIGS. 4*a* and 4*b*, the first portion 136 of the handle aperture 135 is located closer to the intermediate portion 132 and/or knob portion 131 than the second portion 137.

Body portion 133 preferably includes a feature arranged to resists movement of the bolt shroud 140 away from the bolt body 121 when the bolt assembly 120 is assembled. For example, a seat 138 may be defined along a portion of a perimeter of the second portion 137. The seat 138 may receive a portion of the bolt shroud 140 when the bolt handle 130 is secured to the bolt body 121 by the bolt shroud 140 and/or the bolt shroud 140 is retained to the bolt body 121 by the bolt handle 130. The seat may be a recess in an outer surface of the bolt body 121.

Body portion 133 preferably includes a feature arranged to resist movement of the bolt handle 130 out of the bolt body 121 when the bolt assembly 120 is assembled. For example, body portion 133 may include a protrusion 139 (e.g., detent) arranged to interfere with a portion of the bolt shroud and resist movement of the bolt shroud from the second portion 137 to the first portion 136. For example, the protrusion 139 may be positioned at and end of the seat 138 facing the intermediate portion 132. The protrusion may project towards the handle aperture 135 and/or above the seat 138. The protrusion 139 may have a triangular shape and/or may have curved sides. As shown in the illustrated embodiment, a side of the protrusion 139 may face the second portion 137 of the handle aperture and/or a side of the protrusion 139 may face the first portion 136 of the handle aperture. The protrusion 139 may have a height that is equal to and/or less than the depth of a recess defining the seat 138.

Figure 5:
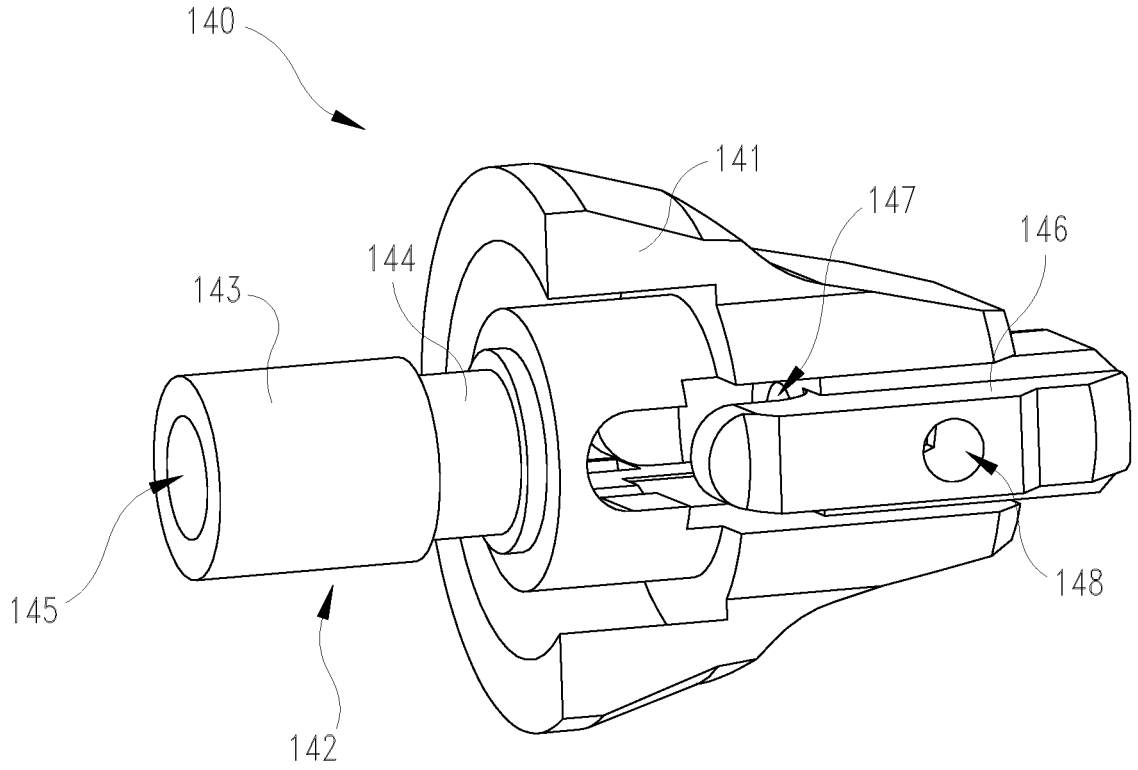
FIG. 5 is a perspective view of a bolt shroud of the bolt assembly of FIG. 2*a*.

As shown in FIG. 5 the bolt shroud 140 includes a bolt shroud body 141. A bolt shroud tang 142 extends from the bolt shroud body 141. The bolt shroud tang 142 has a segment with a first cross-sectional dimension and a second cross-sectional dimension. For example, bolt shroud tang 142 may include a tang body 143 and notch 144 that has a smaller cross-sectional dimension (e.g., diameter) than the tang body 143. The first cross-sectional dimension (e.g., the cross-sectional dimension of the tang body 143 such as its diameter) is the same as or smaller than the cross-sectional dimension (e.g., diameter) of the first portion 136 of the handle aperture of the bolt handle 130 so that the first cross-sectional dimension of the bolt shroud tang 142 can pass at least partially through the first portion 136 of the handle aperture. The first cross-sectional dimension of the bolt shroud tang 142 is preferably larger than the cross-sectional dimension (e.g., diameter) of the second portion 137 of the handle aperture of the bolt handle 130. Advantageously, this can resist movement of the first cross-sectional dimension of the tang body 143 through the second portion 137 of the handle aperture when the bolt shroud 140 is positioned in the second portion 137 of the handle aperture.

A bolt shroud cavity 145 may be defined by the bolt shroud tang 142 and the bolt shroud body 141. A shroud cap 146 may be positioned within a slot defined by the bolt shroud body 141 that is in communication with the bolt shroud cavity. The shroud cap 146 can have a shroud cap aperture 147 configured to receive a rearward end of a firing pin 154 (see FIG. 6) that is part of the bolt assembly 120. An attachment opening 148 defined by the shroud cap 146 may receive an attachment mechanism, such as a screw, for attaching the firing pin 154 to the shroud cap 146.

Figure 6:
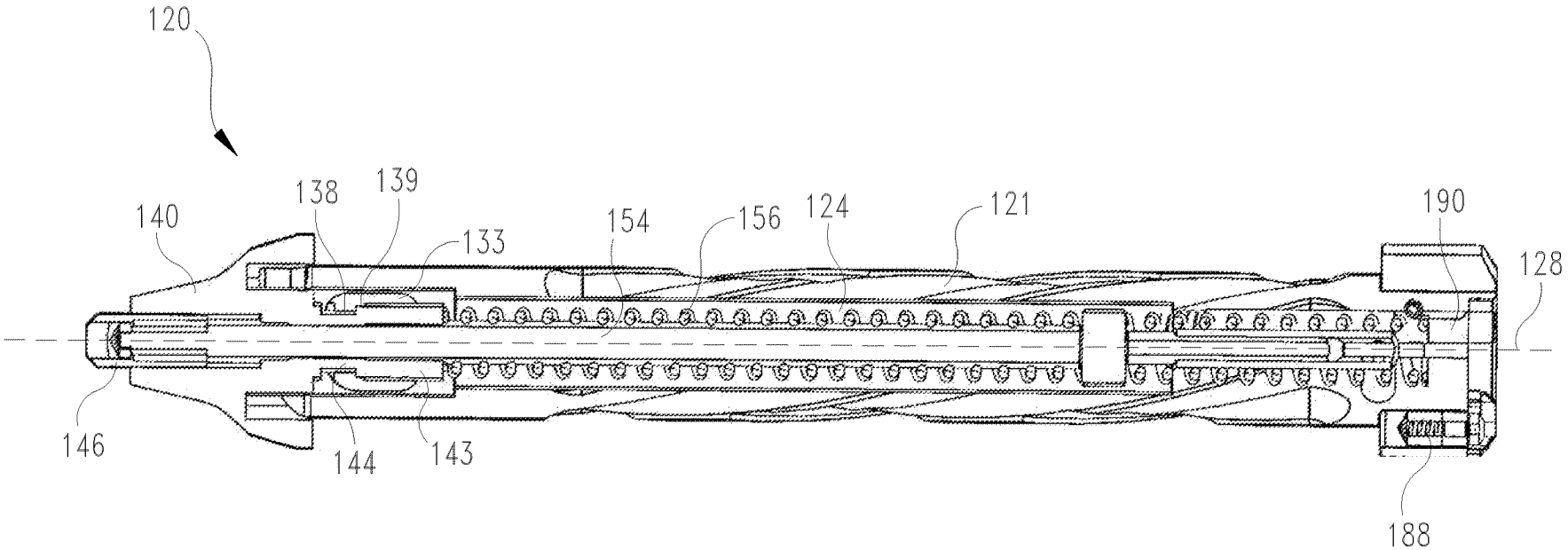
FIG. 6 is a cross-sectional top view of the bolt assembly of FIG. 2*a*.

A cross-sectional view of the bolt assembly 120 is illustrated in FIG. 6. As shown, the bolt body 121 surrounds a firing pin 154. The firing pin 154 fits concentrically within a firing pin spring 156. The firing pin 154 is translatable within the bolt body 121 so that the firing pin 154 can extend towards a chamber of the barrel 180 of the firearm 100. The chamber is configured to hold a cartridge having a bullet, a casing, and a primer. The bullet is fired from the cartridge by the firing pin 154 striking the primer and causing propellant (e.g., a powder charge within the cartridge) to ignite. An extractor 188 is located between the bolt assembly 120 and the barrel 180 and operates to remove spent cartridge casings from the chamber after the bullet from the cartridge has been fired. An ejector 190 then ejects the spent casing from the firearm 100.

Figure 7:
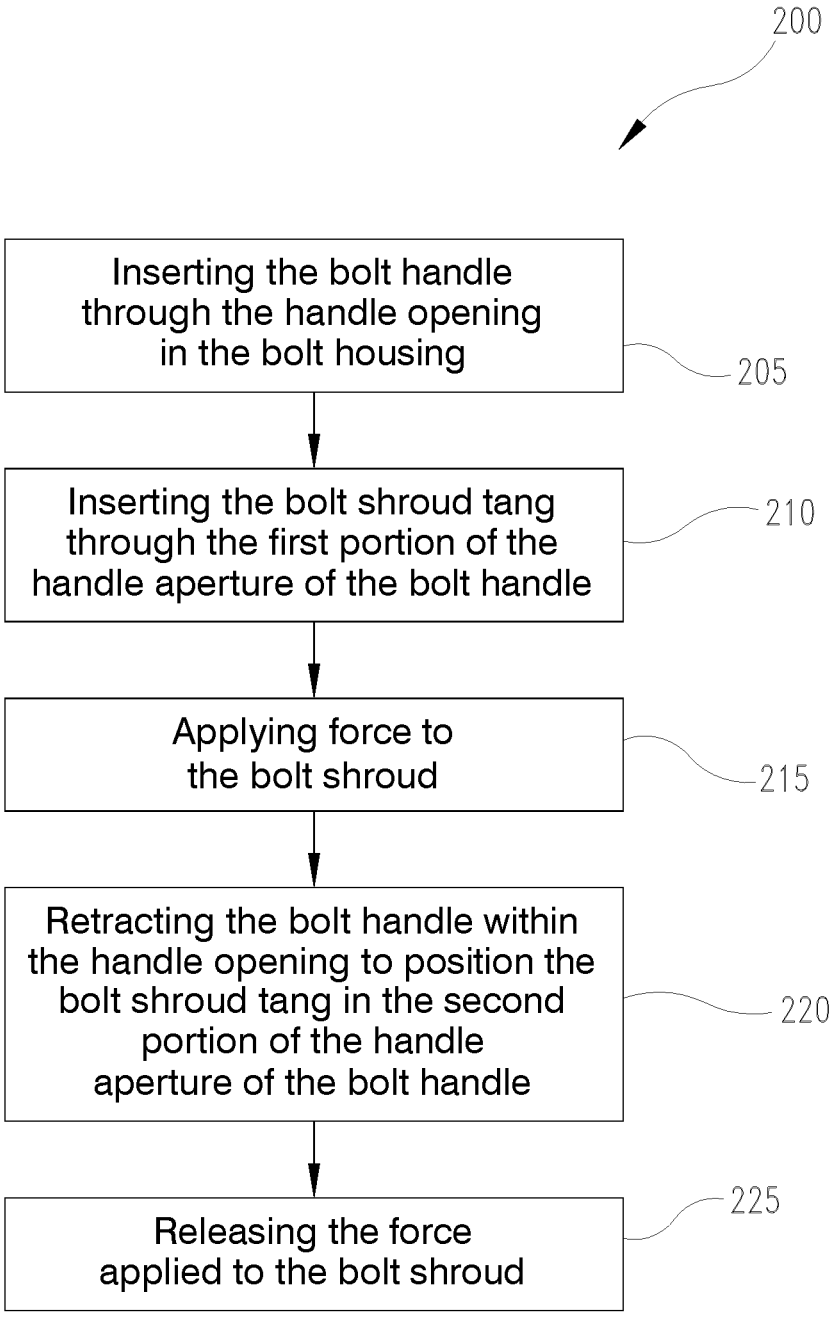
FIG. 7 is a flowchart for a method of assembling the bolt assembly of FIG. 2*a*.

A method of assembling the bolt handle is shown in flowchart 200 illustrated in FIG. 7. In a first stage 205, the bolt handle 130, and more specifically, the body portion 133 of bolt handle 130, is inserted through the handle opening 126 of the bolt body 121. To insert the bolt handle 130, a force that is transverse to the direction of the bolt axis 128 is applied to the bolt handle 130 to insert the body portion 133 of the bolt handle 130 through the handle opening 126. The body portion 133 may be inserted through the bolt handle opening 126 so that the distal end 134 of the bolt handle 130 extends past the outer perimeter of the bolt body 121 (see FIG. 8).

In some embodiments, a hard stop may be present that limits the bolt handle 130 from being inserted through the handle opening 126 past a certain point. As an example, this hard stop may be designed to stop further insertion of the bolt handle 130 when the bolt handle 130 is positioned so that the first portion 136 of the handle aperture of the bolt handle 130 is aligned with the barrel axis 181 of the firearm 100. In the embodiment shown in FIG. 8, the hard stop is formed by the curvature between the intermediate portion 132 and the body portion 133 of the bolt handle 130 (see FIGS. 4*a* and 4*b*). In other embodiments, different forms of hard stops may be used to limit insertion of the of the bolt handle 130 into the handle opening 126 once the first portion of the aperture is aligned with the barrel axis 181, such as a tab that extends from the bolt handle 130 or any other suitable method and/or having different outer dimensions and/or shapes of the bolt handle that interfere with the bolt body 121.

Figure 9:
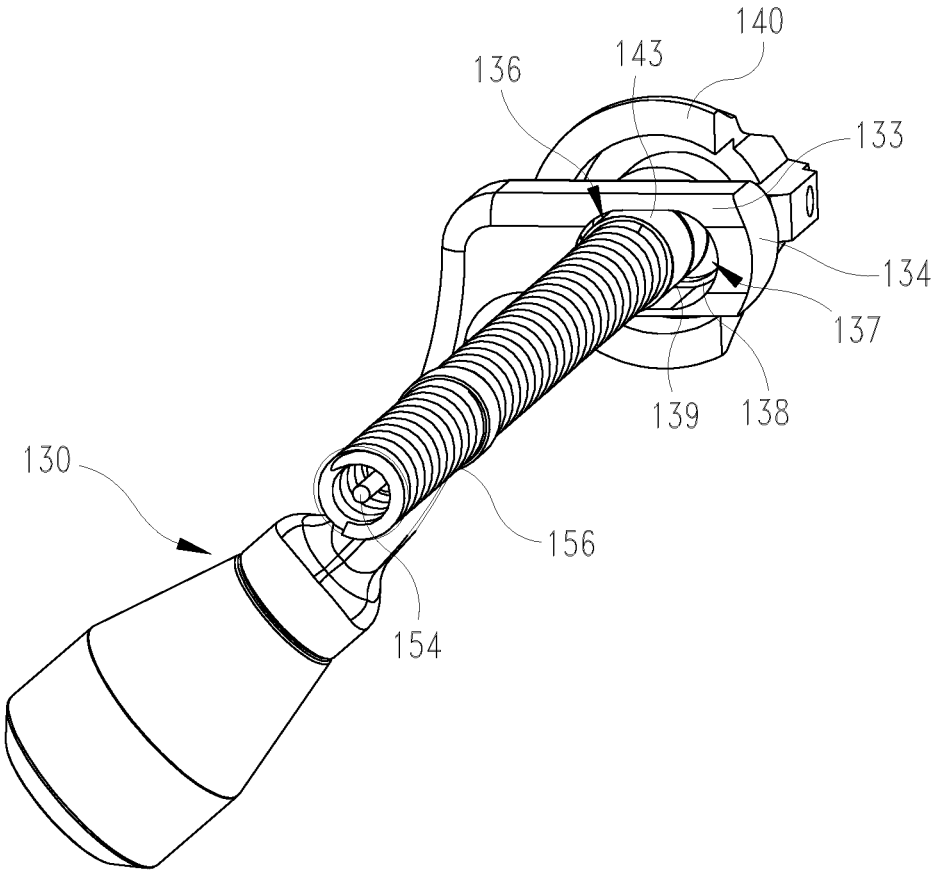
FIG. 9 is a partial perspective view of the bolt assembly of FIG. 2*a* when the bolt shroud is positioned in a first portion of a handle aperture defined by the bolt handle.

In a second stage 210, the bolt shroud tang 142 is passed at least partially through the first portion 136 of the handle aperture of the bolt handle 130. The firing pin 154 may be attached to the bolt shroud 140, so that the firing pin 154 passes through the first portion 136 of the handle aperture along the barrel axis 181 of the firearm 100, and then the bolt shroud tang 142 is inserted at least partially through the first portion 136 of the handle aperture (see FIG. 9). In some embodiments, the bolt shroud tang 142 is inserted through the first portion 136 of the handle aperture until the seat 138 of the bolt handle 130 is positioned rearward of the tang body 143 (e.g., aligned with the notch 144 of the bolt shroud tang 142).

Figure 10:
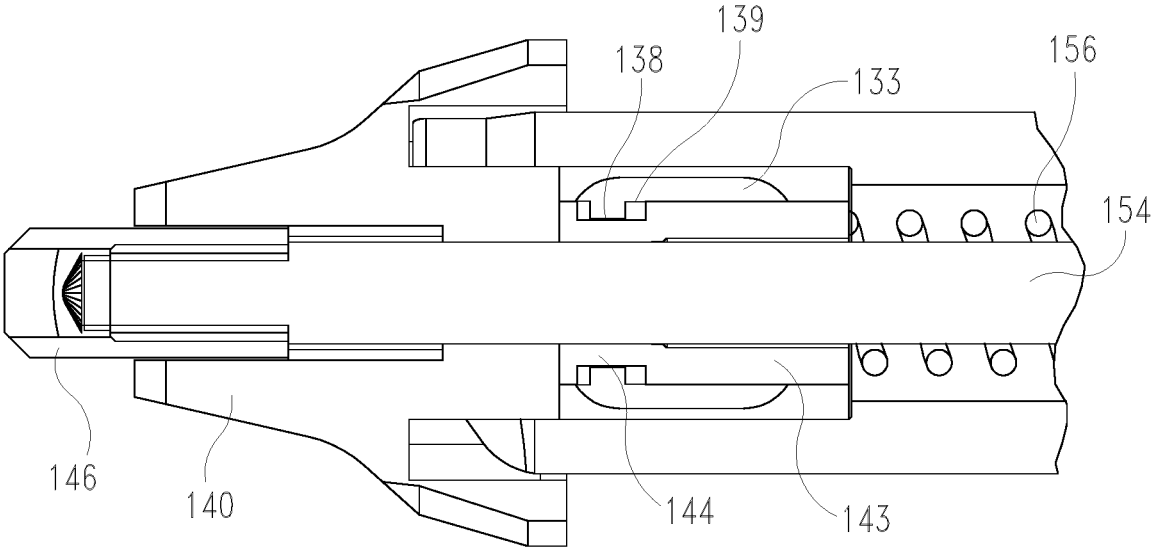
FIG. 10 is a partial cross-sectional top view of the bolt assembly of FIG. 2*a* with the bolt shroud depressed to allow lateral movement of the bolt handle.

When the bolt shroud tang 142 is passed at least partially through the first portion 136 of the handle aperture, the firing pin spring 156 is compressed and applies force in a rearward direction to the bolt shroud 140. Accordingly, in a third stage 215 which may occur during said second stage 210, force is applied to the bolt shroud 140 along the direction of the bolt axis 128 towards the forward end of the bolt body. The force applied to the bolt shroud 140 causes the bolt shroud tang 142 to move forward against the bias of the firing pin spring 156, so that the tang body 143 is forward of the seat 138 and the protrusion 139 (see FIG. 10).

Figure 11:
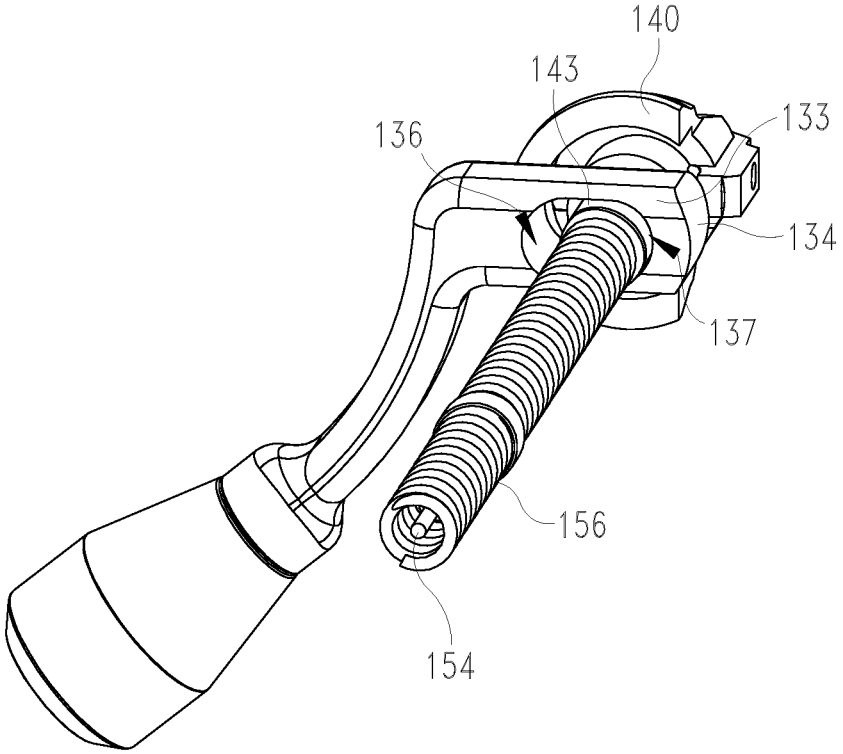
FIG. 11 is a partial perspective view of the bolt assembly of FIG. 2*a* when the bolt shroud is positioned in a second portion of the handle aperture defined by the bolt handle.

In a fourth stage 220, the bolt handle 130 is retracted within the handle opening 126, perhaps while the force from the third stage 215 is still applied to the bolt shroud 140. Preferably, the bolt handle 130 is retracted a sufficient distance so that the second portion 137 of the handle aperture is aligned with the barrel axis 181 of the firearm 100. In some instances, second portion 137 of the handle aperture is aligned with the barrel axis 181 after the bolt handle 130 is retracted to a position in which the distal end 134 is flush with or within the outer perimeter of the bolt handle 130. Preferably, the bolt shroud tang 142 remains at least partially passed through the bolt handle 130 as the bolt handle 130 is retracted within the handle opening 126. Therefore, bolt shroud tang 142 moves from first portion 136 of the handle aperture into second portion 137 of the handle aperture as the bolt handle is retracted within the handle opening 126, as shown in FIG. 11.

In a fifth stage 225, the force applied on the bolt shroud 140 in the second stage 210, third stage 215, and/or fourth stage 220 may be released. The firing pin spring 156 biases the bolt shroud 140 so that the bolt shroud tang 142 contacts the seat 138 around the second portion 137 of the handle aperture. When the bolt shroud tang 142 contacts the seat 138, the protrusion 139 is adjacent to the tang body 143 and resists lateral movement of bolt handle 130 that may move bolt shroud tang 142 into the first portion 136 of the handle aperture.

Figure 12:
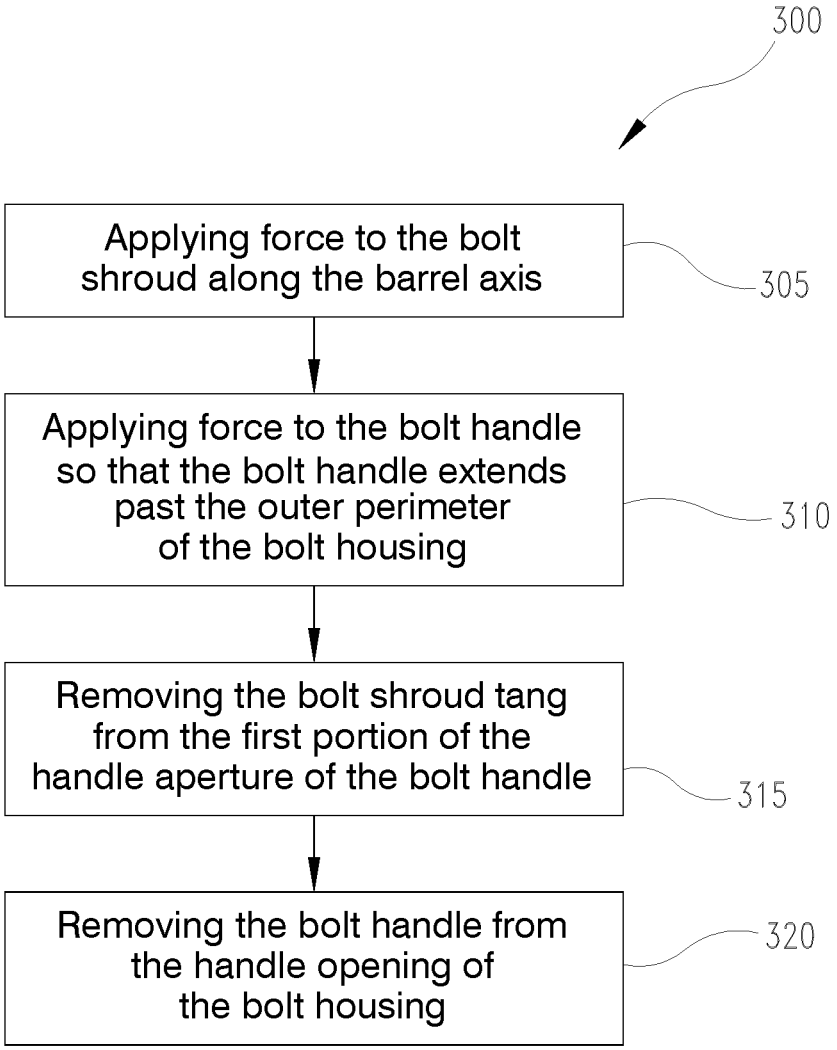
FIG. 12 is a flowchart for a method of disassembling the bolt assembly of FIG. 2*a*.

A method of disassembling the bolt handle is shown in FIG. 12. In a first stage 305, force is applied to the bolt shroud 140 in the direction of the barrel axis 181. Similar to the method of assembly described above, applying force on the bolt shroud 140 causes the tang body 143 of the bolt shroud tang 142 to move forward of the seat 138 and protrusion 139. Therefore, after sufficient force is applied to the bolt shroud 140, the protrusion 139 no longer resists movement of the bolt handle 130 with respect to the bolt shroud 140.

Figure 8:
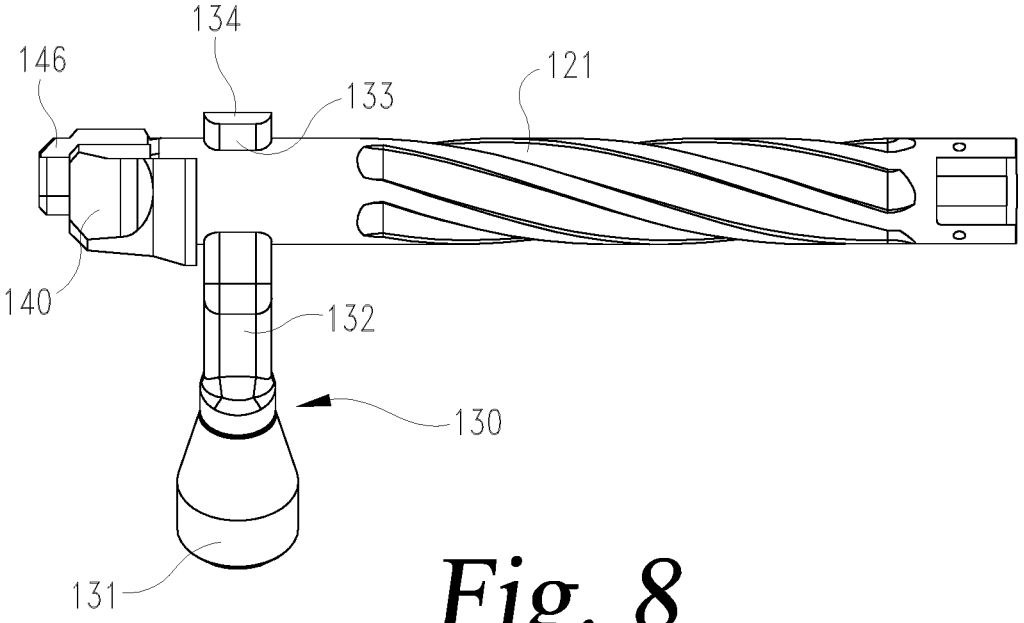
FIG. 8 is a side view of the bolt assembly of FIG. 2*a* during assembly.

In a second stage 310, force is applied to the bolt handle 130 in a direction that is transverse to the barrel axis 181. The force applied to the bolt handle 130 causes bolt handle 130 to move (e.g., translate and/or slide) within the handle opening 126 so that the bolt shroud tang 142 moves from the second portion 137 of the handle aperture into the first portion 136 of the handle aperture of the body portion 133 of the bolt handle 130. During such movement, the distal end 134 of the body portion 133 of bolt handle 130 may extend past the outer perimeter of the bolt body 121, as shown in FIG. 8. The bolt shroud tang 142 and the firing pin 154 may remain stationary as the bolt handle 130 is moved within the handle opening 126.

In a third stage 315, the bolt shroud tang 142 is moved rearward along the barrel axis 181 so that the bolt shroud tang 142 is removed from the first portion 136 of the handle aperture of the bolt handle 130. When the firing pin 154 is attached to the bolt shroud 140, the firing pin 154 may also be removed from the bolt body 121 through the first portion 136 of the handle aperture of the bolt handle 130.

In a fourth stage 320, the bolt handle 130 may be removed from the bolt body 121 by withdrawing the bolt handle 130 from the handle opening 126 of the bolt body 121. When the bolt assembly is assembled, the bolt shroud tang 142 and/or the firing pin prevent the bolt handle 130 from being removed from the handle opening 126. However, with the bolt shroud tang 142 and the firing pin 154 removed, there is clearance for the bolt handle 130 to slide within the handle opening 126 and to be removed for disassembly. Disassembly allows the bolt assembly and/or components thereof to be cleaned, repaired, changed, and/or stored separately from the firearm 100.

Advantageously, arrangements wherein the distal end 134 of the body portion 133 of bolt handle 130 extends beyond the outer perimeter of the bolt body 121 during disassembly, as shown in FIG. 8, can aid in preventing the inadvertent removal of the bolt handle from the bolt body while the bolt assembly is positioned within a firearm. When positioned within the firearm, the bolt resides within a receiver, and the receiver can block the distal end of the bolt handle from movement beyond the outer surface of the bolt body sufficient to move the bolt shroud into the first portion of the aperture of the bolt handle. Accordingly, removable of the bolt shroud, firing pin, and bolt handle can be prohibited when the bolt assembly is in the receiver of the firearm.

Neither the method of assembly described in the flowchart 200 nor the method of disassembly described in the flowchart 300 require rotation of either the bolt handle 130 or the bolt shroud 140 to allow the bolt handle 130 to be attached to or removed from the bolt body 121. The force applied to the bolt handle 130 to insert the bolt handle 130 through the handle opening 126 in the bolt body may be applied in a transverse direction to the bolt axis 128 and is translational rather than rotational. Similarly, the force applied to the bolt shroud 140 may be applied in a direction parallel to the bolt axis 128 and also does not require any rotational force. It is contemplated, however, that movement of the bolt handle and/or bolt shroud may include rotational movement.

The following numbered clauses set out specific embodiments that may be useful in understanding the present invention:

1. A method of assembling a bolt assembly for a firearm, comprising:

passing a distal end of a bolt handle through a handle opening defined by a bolt body so as to position a portion of said bolt handle within said handle opening and said distal end of said bolt handle outside an outer perimeter of said bolt body;

inserting a portion of a bolt shroud into a first portion of an aperture defined by said bolt handle; and retracting said bolt handle relative to said handle opening to move said portion of the bolt shroud into a second portion of the aperture defined by said bolt handle.

2. The method of clause 1, wherein said second portion of the aperture has a cross-sectional dimension that is smaller than a corresponding cross-sectional dimension of said first portion of the aperture.

3. The method of any one of clauses 1-2, wherein retracting said bolt handle brings the distal end of said bolt handle flush with or within the outer perimeter of said bolt body.

4. The method of any one of clauses 1-3, wherein the distal end of the bolt handle is passed through said handle opening until a hard stop prevents further movement of said bolt handle into said handle opening.

5. The method of clause 4, wherein said bolt body includes a firing-pin axis, and wherein said first portion of the aperture is aligned with said firing-pin axis when the bolt handle reaches said hard stop.

6. The method of any one of clauses 1-5, wherein said bolt shroud in said second portion is engagable with a recess of said bolt handle to resist movement of said bolt handle in said handle opening.

7. The method of any one of clauses 1-6, wherein a firing pin is coupled to said bolt shroud and wherein said firing pin is inserted through said first portion of the aperture defined by said bolt handle before said portion of said bolt shroud is inserted through said first portion of the aperture.

8. A method of disassembling a bolt assembly for a firearm, comprising:

moving in a first direction a bolt handle inserted through a handle opening defined by a bolt body so that a portion of a bolt shroud moves into a first portion of an aperture defined by said bolt handle from a second portion of the aperture;

removing said portion of said bolt shroud from said first portion of the aperture defined by said bolt handle; and moving in a second direction opposite said first direction said bolt handle to remove said bolt handle from said handle opening of said bolt body.

9. The method of clause 8, wherein said second portion of the aperture has a cross-sectional dimension that is smaller than a corresponding cross-sectional dimension of said first portion of the aperture.

10. The method of any one of clauses 8-9, comprising moving said bolt shroud in a third direction prior to moving said bolt handle in the first direction.

11. The method of clause 10, wherein removing the portion of the bolt shroud includes moving the bolt shroud in a fourth direction opposite to said third direction.

12. The method of any one of clauses 8-11, wherein a firing pin is coupled to said bolt shroud and wherein said firing pin is removed from said bolt through said first portion of the aperture defined by said bolt handle after said portion of said bolt shroud is removed from said first portion of the aperture defined by said bolt handle.

13. The method of any one of clauses 8-12, wherein moving in the first direction is translational movement.

14. The method of any one of clauses 10-11, wherein moving in the third direction is translational movement.

15. A bolt assembly comprising:

a bolt body including opposing sidewalls and a bolt cavity defined between said opposing sidewalls with a firing pin axis extending through said bolt cavity, wherein a handle opening is defined by said bolt body;

a bolt handle including a knob portion and a body portion, wherein said body portion is insertable through said handle opening of said bolt body, and wherein an aperture having first and second portions is defined by said body portion;

wherein said first portion has a cross-sectional dimension that is larger than a corresponding cross-sectional dimension of said second portion; and wherein said first portion of said aperture is positioned closer to said knob portion of said bolt handle than said second portion of said aperture.

16. The bolt assembly of clause 15, wherein a distal end of said bolt handle is positioned outside an outer perimeter of said bolt body when said first portion of said aperture is aligned with said firing pin axis.

17. The bolt assembly any one of clauses 15-16, wherein said distal end of said bolt handle is flush with or within said outer perimeter of said bolt body when said second portion of the aperture is aligned with said firing pin axis.

18. The bolt assembly of any one of clauses 15-17, further comprising:

a firing pin insertable into said bolt cavity; and a bolt shroud including a bolt shroud tang insertable into said bolt cavity and at least partially through the aperture of the bolt handle, wherein said bolt shroud tang includes a segment having a first cross-sectional dimension and a second cross-sectional dimension each measured transverse to the firing pin axis when the bolt shroud tang is inserted into the bolt cavity.

19. The bolt assembly of clause 18, wherein said bolt shroud tang segment is insertable into and removable from said first portion of the aperture of the bolt handle when said first portion of the aperture is positioned on the firing pin axis.

20. The bolt assembly of any one of clauses 18-19, wherein said bolt shroud tang is blocked from being removed from said bolt cavity by said bolt handle when said second portion of the aperture is aligned with said firing pin axis and said bolt shroud tang segment is positioned in said second portion of the aperture.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A method of assembling a bolt assembly for a firearm, comprising:

passing a distal end of a bolt handle through a handle opening defined by a bolt body so as to position a portion of said bolt handle within said handle opening and said distal end of said bolt handle outside an outer perimeter of said bolt body;

inserting a portion of a bolt shroud into a first portion of an aperture defined by said bolt handle; and retracting said bolt handle relative to said handle opening to move said portion of the bolt shroud into a second portion of the aperture defined by said bolt handle.

2. The method of claim 1, wherein said second portion of the aperture has a cross-sectional dimension that is smaller than a corresponding cross-sectional dimension of said first portion of the aperture.

3. The method of claim 1, wherein retracting said bolt handle brings the distal end of said bolt handle within the outer perimeter of said bolt body.

4. The method of claim 1, wherein the distal end of the bolt handle is passed through said handle opening until a hard stop prevents further movement of said bolt handle into said handle opening.

5. The method of claim 4, wherein said bolt body includes a firing-pin axis, and wherein said first portion of the aperture is aligned with said firing-pin axis when the bolt handle reaches said hard stop.

6. The method of claim 1, wherein said bolt shroud in said second portion is engagable with a recess of said bolt handle to resist movement of said bolt handle in said handle opening.

7. The method of claim 1, wherein a firing pin is coupled to said bolt shroud and wherein said firing pin is inserted through said first portion of the aperture defined by said bolt handle before said portion of said bolt shroud is inserted through said first portion of the aperture.

8. A method of disassembling a bolt assembly for a firearm, comprising:

moving in a first direction a bolt handle inserted through a handle opening defined by a bolt body so that a portion of a bolt shroud moves into a first portion of an aperture defined by said bolt handle from a second portion of the aperture;

removing said portion of said bolt shroud from said first portion of the aperture defined by said bolt handle; and moving in a second direction opposite said first direction said bolt handle to remove said bolt handle from said handle opening of said bolt body.

9. The method of claim 8, wherein said second portion of the aperture has a cross-sectional dimension that is smaller than a corresponding cross-sectional dimension of said first portion of the aperture.

10. The method of claim 8, comprising moving said bolt shroud in a third direction prior to moving said bolt handle in the first direction.

11. The method of claim 10, wherein removing the portion of the bolt shroud includes moving the bolt shroud in a fourth direction opposite to said third direction.

12. The method of claim 10, wherein moving in the third direction is translational movement.

13. The method of claim 8, wherein a firing pin is coupled to said bolt shroud and wherein said firing pin is removed from said bolt through said first portion of the aperture defined by said bolt handle after said portion of said bolt shroud is removed from said first portion of the aperture defined by said bolt handle.

14. The method of claim 8, wherein moving in the first direction is translational movement.

15. A bolt assembly comprising:

a bolt body including opposing sidewalls and a bolt cavity defined between said opposing sidewalls with a firing pin axis extending through said bolt cavity, wherein a handle opening is defined by said bolt body;

a bolt handle including a knob portion and a body portion, wherein said body portion is insertable through said handle opening of said bolt body, and wherein an aperture having first and second portions is defined by said body portion;

wherein said first portion has a cross-sectional dimension that is larger than a corresponding cross-sectional dimension of said second portion;

wherein said first portion of said aperture is positioned closer to said knob portion of said bolt handle than said second portion of said aperture; and wherein a distal end of said body portion of said bolt handle is positioned outside an outer perimeter of said bolt body when said first portion of said aperture is aligned with said firing pin axis.

16. The bolt assembly of claim 15, wherein said distal end of said bolt handle is flush with or within said outer perimeter of said bolt body when said second portion of the aperture is aligned with said firing pin axis.

17. A bolt assembly comprising:

a bolt body including opposing sidewalls and a bolt cavity defined between said opposing sidewalls with a firing pin axis extending through said bolt cavity, wherein a handle opening is defined by said bolt body;

a bolt handle including a knob portion and a body portion, wherein said body portion is insertable through said handle opening of said bolt body, and wherein an aperture having first and second portions is defined by said body portion;

a firing pin insertable into said bolt cavity; and a bolt shroud including a bolt shroud tang insertable into said bolt cavity and at least partially through the aperture of the bolt handle, wherein said bolt shroud tang includes a segment having a first cross-sectional dimension and a second cross-sectional dimension each measured transverse to the firing pin axis when the bolt shroud tang is inserted into the bolt cavity;

wherein said first portion has a cross-sectional dimension that is larger than a corresponding cross-sectional dimension of said second portion; and wherein said first portion of said aperture is positioned closer to said knob portion of said bolt handle than said second portion of said aperture.

18. The bolt assembly of claim 17, wherein said bolt shroud tang segment is insertable into and removable from said first portion of the aperture of the bolt handle when said first portion of the aperture is positioned on the firing pin axis.

19. The bolt assembly of claim 18, wherein said bolt shroud tang is blocked from being removed from said bolt cavity by said bolt handle when said second portion of the aperture is aligned with said firing pin axis and said bolt shroud tang segment is positioned in said second portion of the aperture.

* * * * *